US008783083B2

(12) United States Patent
Campian

(10) Patent No.: US 8,783,083 B2
(45) Date of Patent: Jul. 22, 2014

(54) APPARATUS AND METHOD TO CRADLE AND HEM PANELS AT AN ASSEMBLY-LINE STATION

(75) Inventor: Jonathon R. Campian, Troy, MI (US)

(73) Assignee: Jonathon R. Campian, Madison Hts., MI (US)

( * ) Notice: Subject to any disclaimer, the term of this patent is extended or adjusted under 35 U.S.C. 154(b) by 775 days.

(21) Appl. No.: 13/057,096

(22) PCT Filed: Aug. 4, 2009

(86) PCT No.: PCT/US2009/052657
§ 371 (c)(1),
(2), (4) Date: Feb. 1, 2011

(87) PCT Pub. No.: WO2010/017171
PCT Pub. Date: Feb. 11, 2010

(65) Prior Publication Data

US 2011/0126603 A1 Jun. 2, 2011

Related U.S. Application Data

(60) Provisional application No. 61/086,001, filed on Aug. 4, 2008.

(51) Int. Cl.
*B21D 39/00* (2006.01)
*B21D 39/02* (2006.01)

(52) U.S. Cl.
CPC ..... *B21D 39/021* (2013.01); *B21D 39/023* (2013.01)
USPC ..... 72/214; 29/243.58

(58) Field of Classification Search
CPC ..... B21D 19/04; B21D 19/043; B21D 39/02; B21D 39/023
USPC ..... 72/210, 211, 214–217, 219, 220; 29/243.58
See application file for complete search history.

(56) References Cited

U.S. PATENT DOCUMENTS

| | | | | |
|---|---|---|---|---|
| 8,028,559 | B2 * | 10/2011 | Toeniskoetter | 72/214 |
| 2002/0170332 | A1 | 11/2002 | Denis et al. | |
| 2009/0139293 | A1 * | 6/2009 | Kinouchi et al. | 72/220 |

FOREIGN PATENT DOCUMENTS

| | | | |
|---|---|---|---|
| JP | 2001-047163 | A | 2/2001 |
| JP | 2002-301527 | A | 10/2002 |
| WO | 2006-085858 | A2 | 8/2006 |

* cited by examiner

*Primary Examiner* — Debra Sullivan

(57) ABSTRACT

An apparatus and method to cradle and hem panels at an assembly-line station. A cradle assembly is configured to conform to the shape of a first sheet material and prevents deformation of the class-a surfaces. A first robotic arm operatively associated with said cradle assembly and a slide-assist assembly cooperate to stabilize the cradle and secure a cradle anvil against the first sheet material. A roller head for hemming said first sheet material supported on a second robotic arm. The second robotic arm moves the roller head around the periphery of the first sheet material and against the cradle anvil to form a hem.

10 Claims, 7 Drawing Sheets

APPARATUS AND METHOD TO CRADLE AND HEM PANELS AT AN ASSEMBLY-LINE STATION

CROSS-REFERENCE TO RELATED APPLICATIONS

This application claims the benefit of U.S. Provisional Application No. 61/086,001, filed Aug. 4, 2008. The entire disclosure of the above application is incorporated herein by reference.

FIELD

The present disclosure relates to vehicle body assembly and, more particularly, to a system for in-situ locating, fixturing and hemming a body panel at an assembly-line station.

BACKGROUND

This section provides background information related to the present disclosure which is not necessarily prior art.

This specification describes a system that forms and joins sheet material and, in particular, a hemming device and method of use at an assembly-line station, which is considered on-line, where it is sometimes preferred versus off-line where an added station and event is expensed. The assembly-line station environment presents partially assembled panels oriented in vehicle position, which is reversed relative to off-line hemming. A hemming tool assembly having a roller hemming unit operates in this environment with unlimited hem flange orientation without physical attachment to a counter-pressure device, and with the flexibility to manage multiple vehicle body model shapes at a single assembly-line station.

One of the earliest operations required in the history of automobile assembly was on-line joining of panels to form a variety of body assemblies to build up a vehicle body. On-line welding pinches the panels together between two welding-tips via a common jaw, then a weld current is induced until securely joined. Similarly, on-line roller hemming pinches the panels together between two rollers via a common jaw, then multiple passes are made until securely joined. Welding and hemming are both widely used. Welding is the most popular method though it is not often used on class-a surfaces due to marking, while hemming is intended for class-a joining. An example of off-line hemming may be found in U.S. Pat. No. 5,454,261 issued on Oct. 3, 1995 to Campian for HEMMING MACHINE AND METHOD OF OPERATION. Examples of known on-line hemming are set forth in U.S. Pat. No. 7,017,268 issued on Mar. 16, 2006 to Lang for SEAL REFORMING METHOD AND APPARATUS, and U.S. Pat. No. 7,500,373 issued on Mar. 10, 2009 to Quell for FLANGING DEVICE AND FLANGING METHOD WITH COMPONENT PROTECTION.

While the above-referenced patents provided advancements in the state of the art of machines for joining two panels together, opportunity for design and feature improvement remained available. One of the difficulties of known on-line panel joining devices has to do with backing up the pressures induced to the hem flange to prevent panel deformation. As is known in the art, pinch rollers provide pressure to a pair of rollers, but are difficult to program and have angular manipulation restraints. The restraint on angular manipulation arises from the use of a common jaw supporting both rollers which results in an inability to make complex panel shapes or bow-tie-flanges—e.g., final flanges that vary the completeness of the folded flange from closed to partly open to fully open which are common to automotive assemblies.

Existing off-line hemming systems possess a stable and rigid lower anvil that is generally mounted horizontally with the floor. The incoming assembly is unattached to other assemblies allowing free and easy handling and orientation. The assembly drops onto the anvil from above, gravity assisted, with the class-a facing down on the anvil and the flanges to be hemmed facing up and out. The hemming head has open real estate to manipulate while pushing and driving the flange downward into the anvil. On the other hand, on-line hemming systems orient the part with the class-a facing outboard and the hemming work is done vertically to the floor which makes it impossible to use conventional off-line hemming heads and rollers due to the orientation of the part. There is also little or no room for the robot knuckle to manipulate from the inside of the vehicle to the outside, as the hemming forces dictate. Even if the robot knuckle has enough room to work from the inside out, the class-a metal would distort from the pressures required to hem.

To date there is no way to use a single conventional roller hemming tool in an on-line hemming station. On-line hemming has been performed using non-conventional pinch rollers that use a counter-pressure roller. It is a limited technique that does not yield high-quality flanges. The main issues are that the pressures applied are angular to the surface during the prehem passes, which have the greatest effect on the final hem quality. During prehem, the pinch rollers form a v-shape and the robotic paths attempt to compensate the angular skid of both paths simultaneously. Reviewing after a pinch rolling operation directly on class-a reveals scratches and skid marks evident on the class-a surface.

To protect the class-a surface from this damage, a known protective cover is used between the counter-pressure wheel and the class-a surface. It protects the class-a by having the counter-pressure wheel travel along a machined race track on the face of the cover, and at the same time limits the rotational freedom of the hemming tool as it is locked into following the track exactly. Reprogramming different angles within the path requires substantial re-tooling of the machined race track. To change angles if a path needs reprogramming requires the cover's surface to be welded and re-cut to the new angle. Abrupt changes to the attack angles are known to be done with pinch rollers by physically adding additional rollers to the head assembly.

Unfortunate features of pinch-rollers include: (a) the flange-side roller requires an attachment to a jaw with a direct relationship to a back-side counter-pressure roller also attached to same jaw for countering the applied force of the flange-side roller to prevent panel deformation; (b) the pinch rollers are locked in relationship to one another and have no opportunity to be quickly swapped out by rollers of different shapes to more robustly hem different panel shapes; (c) the pinch rollers possess an inherent inability to adjust the yaw, pitch or roll of the rollers during the hemming process to more robustly follow different panel shapes and associated attack angles; (d) the program path of both rollers are locked together via the jaw, and have extreme programming limitations of the counter-pressure roller with relationship to the panel surface and/or backer track; and (e) the hem attack angle is locked and non-adjustable, changing this requires introducing multiple rollers, each locked to different angles.

Another prior approach to address on-line hemming is the use of sliders, which offer low quality and little flexibility to manage multiple vehicle body model shapes on the same assembly-line.

Prior approaches to address on-line hemming have failed to overcome the aforementioned problems. Accordingly, an on-line hemming system that captures all the flexibility that off-line systems exhibit remains wanting.

SUMMARY

This section provides a general summary of the disclosure, and is not a comprehensive disclosure of its full scope or all of its features.

The specification describes an apparatus and method that overcomes the problems of known techniques for forming and joining standard hem flanges of a first sheet material to a second sheet material at an assembly-line station.

The apparatus provides tooling that uses a single roller which is disconnected from the counter-pressure device. One roller with a solid backing yields a more robust path trace and allows for variable tool angles during the course of the path, permitting any type of flange combination to be made, and reprogramming without machining.

In order to provide a solid backing, the first sheet material is cradled by a movable anvil when roller hemming to a second sheet material. Cradling prevents the class-a surface from being distorted by the hemming roller forces. Such distortion can be picked up either immediately or after the paint process that will reveal bolder and smoother light reflections than unfinished metal. Protection is achieved via the cradle anvil which is CNC manufactured from different materials dependant on the product quantities and duty cycle. The cradle anvil for high-quantity panel runs are preferably made from metals such as steel and iron, while low panel runs are preferably made from kirksite or even plastics such as urethane.

The roller hem tooling described herein is flexible enough to accommodate panels of various sizes, shapes, contours and accessibility at the same station. To this end, the roller hem tooling may be used in conjunction with a robotic arm in operation with a variety of stations. A variety of panel orientations, flange lengths, flange shapes, part thickness, and material type are all variables. As a result, the roller hem tooling has unlimited attack angle capability to produce completed seams with variable shapes as desired, and with easy program changes to chase part changes as they may be received.

Because the panel flanges in an on-line system are generally hidden behind the class-a surface, the system preferably utilizes a positional pressure variance unit (PPVU) similar to that disclosed in U.S. Pat. No. 7,254,973 operatively associated with a programmable positioning apparatus in the form of a robotic arm. A biasing element in the form of a compression spring is operably disposed within the cylinder and atop the piston. As further described below, the capture of the biasing element in the present invention is rearranged from the PPVU disclosed in U.S. Pat. No. 7,254,973 to urge the piston to a retracted position rather than an extended position.

The described system also includes at least one cradle assembly unit operatively associated with a programmable positioning apparatus in the form of a robotic arm. Multiple cradle assemblies may be fitted on one robot arm for fast model change and easy storage. Disconnected and independent of the PPVU hemming tool, the cradle assembly is fit tight and rigid against the body panel to be hemmed, but not so tight as to damage or mark class-a surface. To date robots have not been configured to achieve a level of rigidity required to keep adequate positional resistance on the cradle assembly to counteract the roller hemming tool. Gear backlash, bearing clearances, encoder accuracy, motor drive control and arm-cantilever-flex add to make a typical commodity robot incapable of sustaining the required positional resistance to support the present cradle stability requirement.

The described system employs slide-assists that are releasably coupled to the cradle assembly to enhance a secure match of the cradle to the part surface. Slide-assists are urged against cradle frame corner pins via a linear cylinder. The force applied through the pins to the frame in turn urges the anvil and part surface to conform to one another but not so much as to deform the class-a surface.

After secure matching between the anvil and the first part surface is achieved, a brake is applied to the cylinders of the slide-assists. The cylinder will now remain stationary holding the slide-assist and anvil with sustained resistance. A rigid cradle anvil is achieved with fixed points from the slide-assists at the bottom of the cradle frame and fixed points at the top of the cradle frame from the robot arm.

The described system may employ a docking fixture at the assembly-line station to temporarily dock the body-in-white assembly during the hemming operation. The accuracy of the body dimensions are held close, though the welding inaccuracies and the docking inaccuracies between the frame and the trolley, and the trolley and the track, result in significant dimensional variance that must be accommodated in order to provide a quality hem.

The docking fixture may include a commercially available positional recognition system to assist the robots to best align the cradle and PPVU hemming programs to play out. The positional recognition system software and hardware can pass offset values to the robots simultaneously to keep them in sync with each other and the panel.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
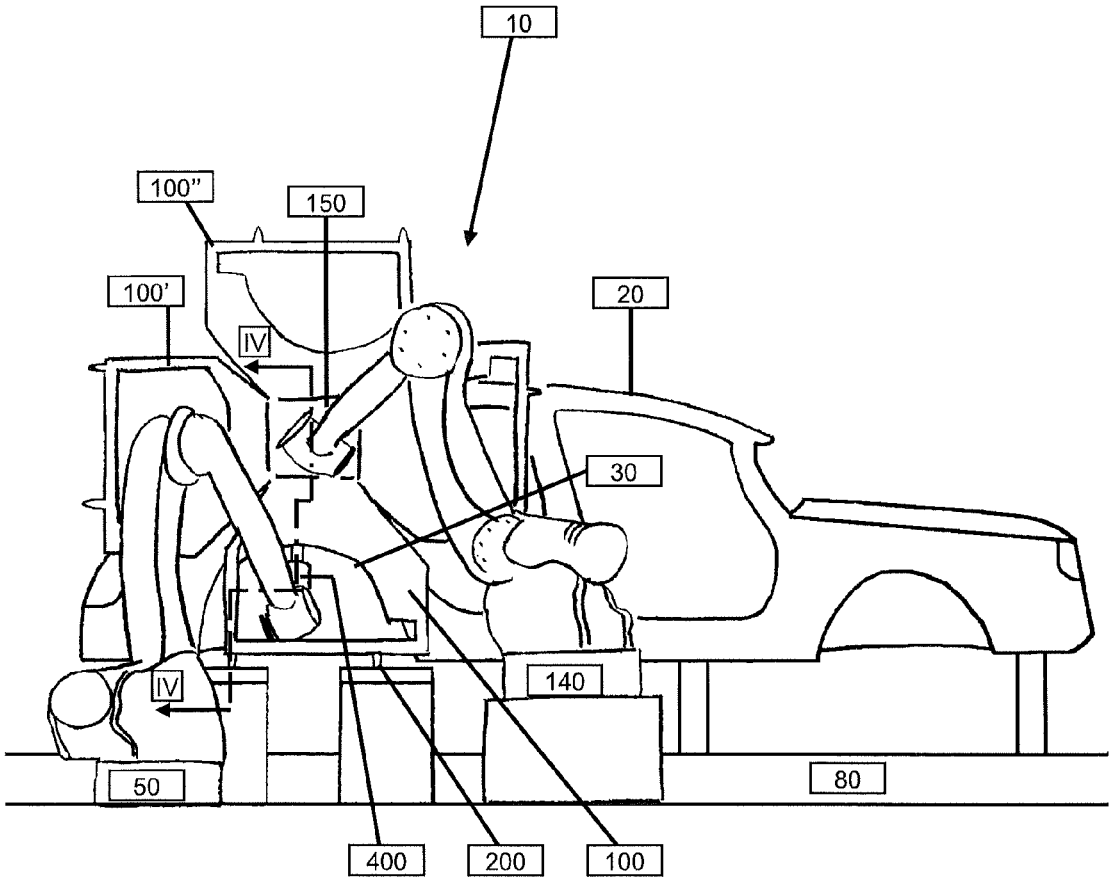
FIG. 1 is a perspective view of the cell at an assembly-line station.

With reference first to FIG. 1, an embodiment of an on-line hemming station 10 is illustrated in a perspective view. The assembly-line hemming station 10 includes a body-in-white 20 docked at a hemming station 10. The body 20 is received from the assembly-line track 80 with a partially flanged first sheet material 30 requiring a hemming operation that is located primarily about the rear wheel opening.

Figure 4:
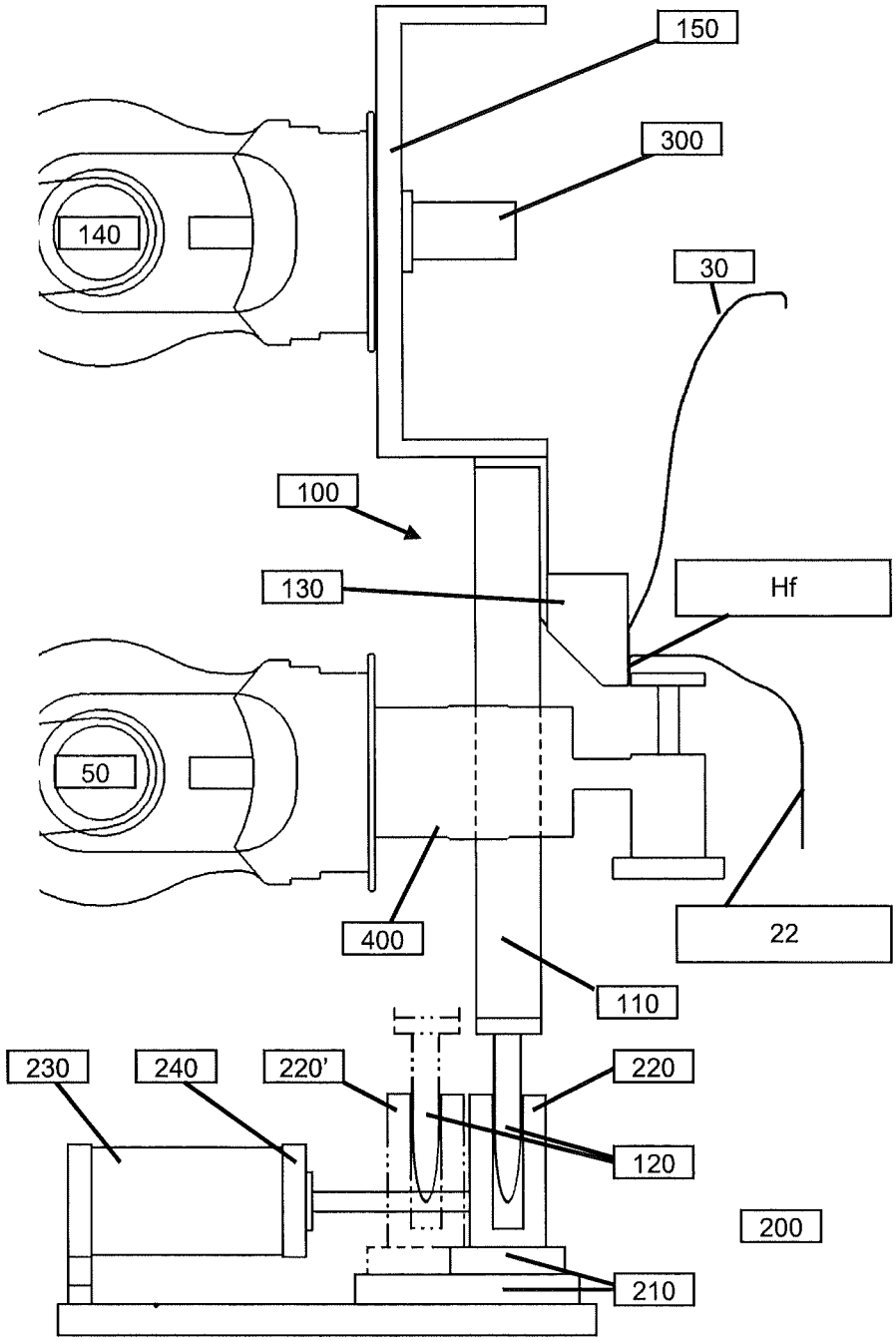
FIG. 4 is a sectional view IV-IV from FIG. 1 showing the final hem forming process.
Figure 6:
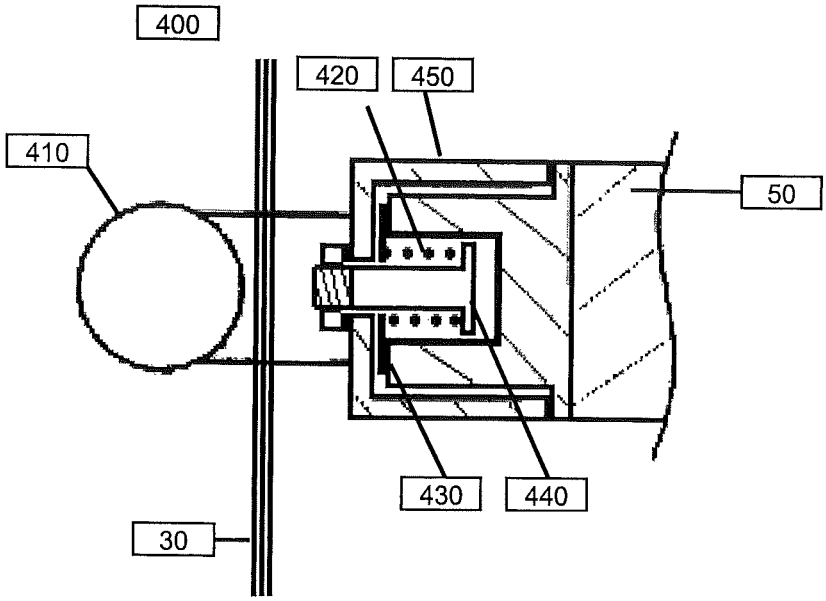
FIG. 6 is a section of a pull-type PPVU in a relaxed or retracted position.
Figure 7:
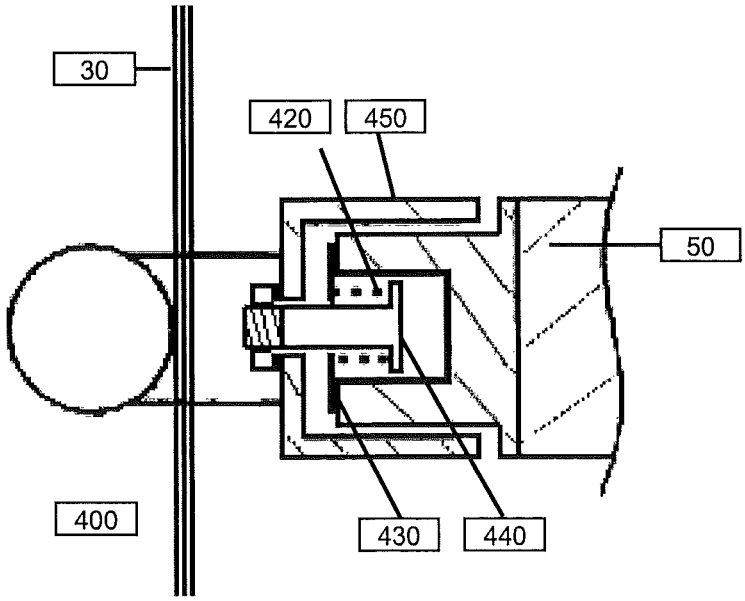
FIG. 7 is a section of the PPVU shown in FIG. 6 in a pulled or hemming position.
Figure 8:
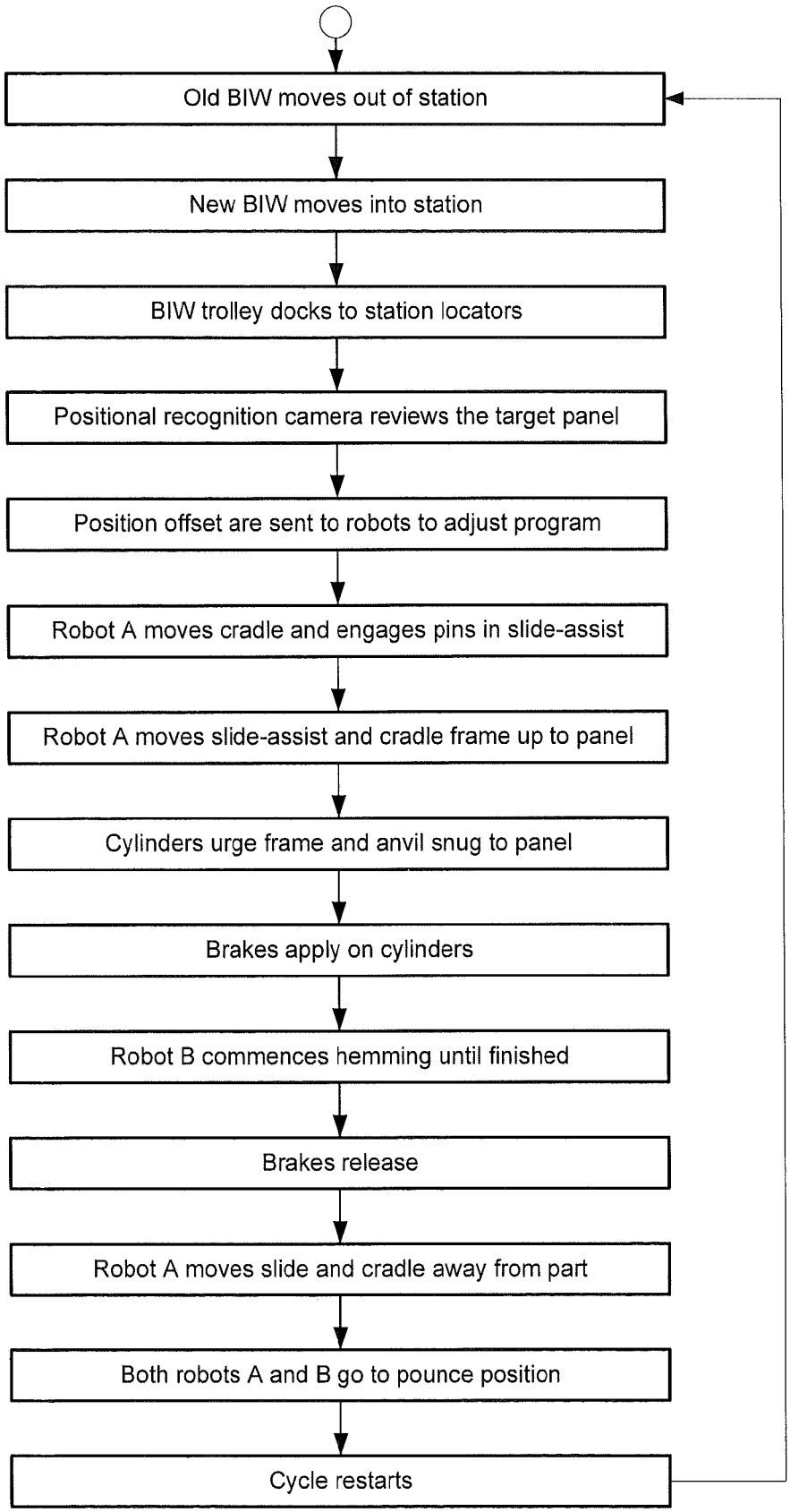
FIG. 8 is a Sequence Flow-Chart of the hemming operation.

A roller head 400 for hemming the first sheet material 30 is outlined in the sectional views of FIGS. 4, 6 and 7. The roller head 400 is of a pull-type, different than those used off-line in that it has no compliance when pushed. A shaft extends from one end of the cylinder and supports a roller that creates biasing compliance when pulled on. By pulling instead of the traditional pushing of the biasing element, the present invention can achieve the feature of unlimited hemming attack angles that an off-line system enjoys; a feature that pinch rollers can not achieve.

When the wheel 410 is not in contact with the first sheet material 30, the spring 420 expands between a spring-plate 430 and a t-head bolt 440, urging the cylinder 450 and roller 410 toward the robotic arm 50. When the wheel 410 is hooked in contact with the first sheet material 30 and the robot 50 pulls on it, the spring 420 compresses between a spring-plate 430 and a t-head bolt 440, thus producing the positional pressure of a selected amount to produce a quality hem.

A robotic arm 50 operatively associated with the roller head 400 for hemming a first sheet material 30 is bolted to the floor as exhibited in FIG. 1. A positional recognition camera 300 mounted to the center hub 150 reviews the first sheet material 30 from its pounce position. The camera 300 is configured to send offset data to both robots 50 and 140 to manipulate the robots reference frame to align the hemming station 10 with the first sheet material 30. A presently preferred positional recognition camera 300 is the single camera, 3-D recognition system providing robotic guidance without the use of calibration targets or structured lighting, available from Comau, Inc. of Southfield, Mich. as the RecogniSense system.

The roller head 400 must wait until the cradle 100 is engaged prior to any flanging operation at the on-line assembly. As best viewed in FIG. 2, the cradle assembly 100 comprises a frame 110 onto which mounts pins 120 for pressure application across the lower portion of the frame 100, and a cradle anvil 130 made from either plastics or metal, dependent on the life expectancy of the tooling. The cradle anvil 130 conforms rigidly to the shape of a first sheet material 30 to prevent deformation of the class-a surfaces during roller hemming. The cradle assembly 100 is affixed to the robotic arm 140 via a center hub 150, as best viewed in FIG. 3. The center hub 150 may be configured to accept up to four cradle assemblies 100. Changing panel models only requires robot 140 to rotate about its wrist axis in 90° increments.

Figure 2:
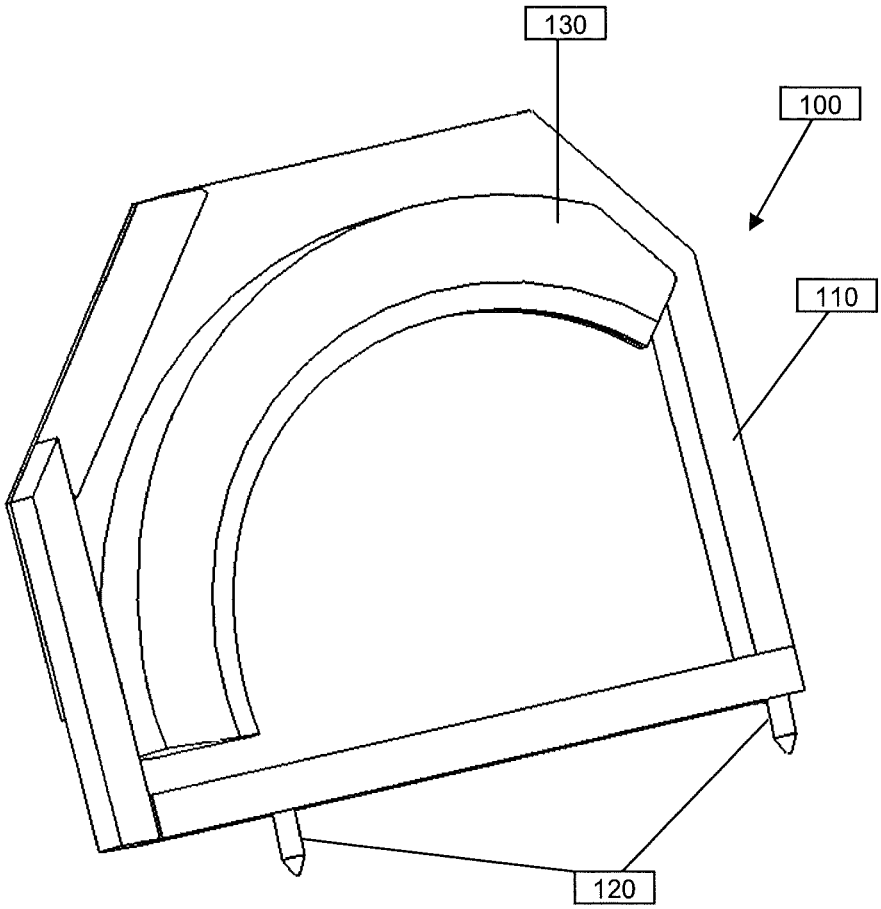
FIG. 2 is an isometric view of a single cradle.
Figure 3:
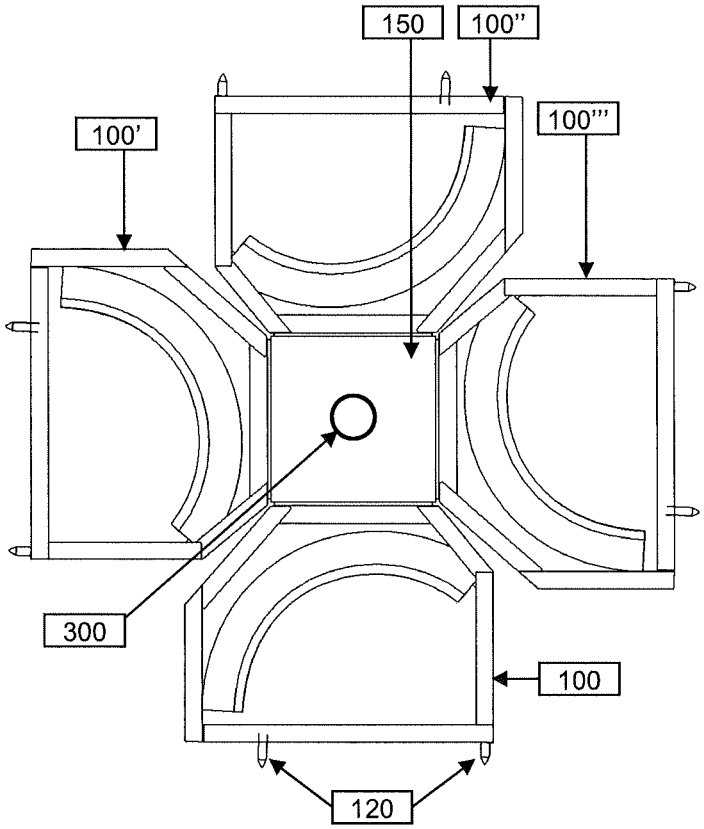
FIG. 3 is a perspective view of the cradle assembly, which is reversed from FIG. 1.

Slide-assist assemblies 200 are mounted below first sheet metal 30 (see FIGS. 1 and 4) and operatively associate with cradle frame pins 120 that slip loosely into guide pockets 220 to form a structure to assist stabilizing the cradle assembly against the roller hemming pressures. While FIGS. 2-4 illustrate the use of two slide-assists, one skilled in the art will recognize that the number of slide-assists may vary as required by the size and configuration of the sheet material being formed. The slide-assist assembly includes (see FIG. 4) a slide rail 210 and a pocket-guide 220 mounted to the slide rail 210 that accepts the frame pin 120. Once the pin 120 is introduced via robot 140, the slide rail 210 is dragged via the pin 120 from its retracted position until the cradle assembly 100 encroaches the first sheet material 30. The cylinder 230 operatively associated with the robot program and mounted to the slide rail 210 is then charged to drive the pocket-guide 220 and push the pin 120 that in turn moves the entire cradle assembly 100, including the anvil 130, against the first sheet material 30. The pressure in the slide cylinder 230 must be regulated so as not to disturb the class-a surface. After the cradle anvil 130 and the first sheet material 30 are matched snugly, and operatively associated with the robot program, a cylinder brake 240 mounted to the cylinder 230 is applied to lock the cradle frame 110 rigid during the hemming operation.

Figure 5:
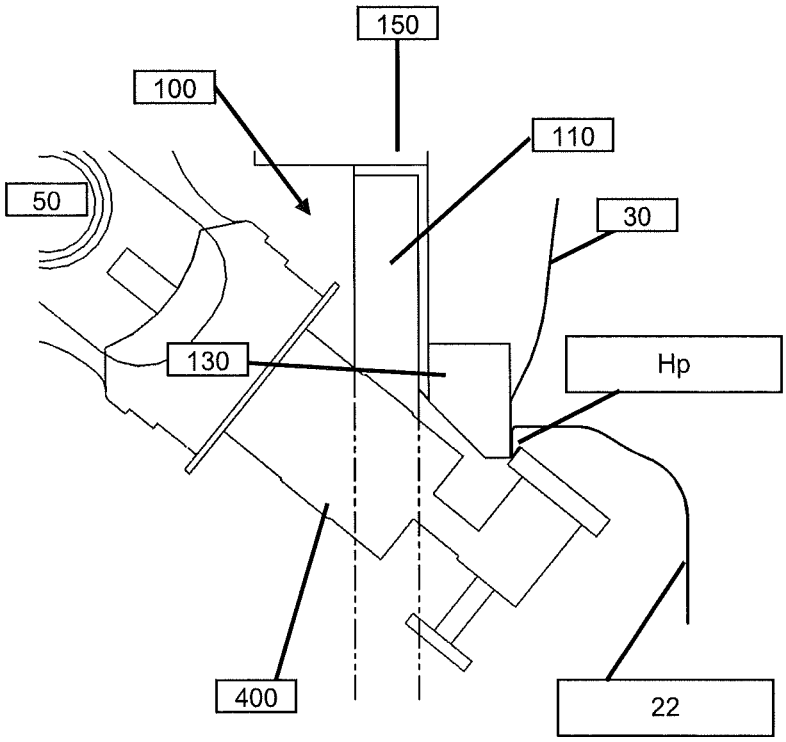
FIG. 5 is a sectional view similar to that shown in FIG. 4 showing the pre-hem forming process.

The prehem and final hem passes are then executed by initially looping the roller 410 around the material 30 with a fish-hook movement. The hemming process may be completed with a single pass or multiple passes, depending on the configuration and materials to be joined. The contact relationship is viewed in FIGS. 5 and 4, respectfully, while the robotic arm 140 and slide-assists 200 are kept immobile. Once the hemming is complete, robot 50 moves the PPVU 400 to a pounce position. The brakes 240 then release and the cylinders 230 release to atmosphere as the pins 120 pull the slide-assists 200 away from the first sheet metal 30. The robot 140 swings the cradle assembly 100 out of the guide pockets 200 and back to a pounce position. At this point, the body-in-white is moved away from the assembly-line hemming station and a new body-in-white is moved into the assembly-line hemming station. The process then recycles.

While the present description will focus and describe forming a pre-hem Hp and a final hem Hf of a rear wheel arch 22 of a vehicle body 20, it is not limited to simple flange formations such as a wheel arch 22. Therefore, one skilled in the art will recognize that the system so described has application to a variety of body panel configurations. Furthermore, the system may have application to the assembly of non-vehicle-related products; e.g., appliances or metal cabinets.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. The terminology used herein is for the purpose of describing particular example embodiments only and is not intended to be limiting. As used herein, the singular forms "a", "an" and "the" may be intended to include the plural forms as well, unless the context clearly indicates otherwise. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on", "engaged to", "connected to" or "coupled to" or "operatively associated with" another element or layer, it may be directly on, engaged, connected or coupled to the other element or layer, or intervening elements or layers may be present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various materials, elements, components, regions, layers and/or sections, these elements, components, regions, layers and/or sections should not be limited by these terms. These terms may be only used to distinguish one material, element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90° or at other orientations) and the spatially relative descriptors used herein interpreted accordingly.

What is claimed is:

1. An apparatus to cradle and hem panels at an assembly-line station with a docked body-in-white that has a first sheet material requiring a hemming operation, the apparatus comprising:

a roller head for hemming the first sheet material of the docked body-in-white;

a first robotic arm operatively associated with said roller head;

a cradle assembly positionable from a pounce position spaced apart from the docked body-in-white to a final position cradling the docked body-in-white, said cradle assembly having a fixed anvil that conforms to and rigidly supports the first sheet material to at least in part oppose pressure applied by said roller head during said hemming the first sheet material; and a second robotic arm operatively associated with said cradle assembly for positioning said cradle assembly from said pounce position spaced apart from the docked body-in-white to said final position cradling the docked body-in-white, said first robotic arm positioning said roller head in a plurality of hemming attack angles relative to said fixed anvil as the docket body-in-white is at the assembly-line station.

2. The apparatus of claim 1 wherein said roller head comprises a pull-design that provides a roller to deliver said pressure at said plurality of hemming attack angles to hem the first sheet material.

3. The apparatus of claim 1 wherein said cradle assembly comprises a mounting frame supporting said fixed anvil and operably coupled to said second robotic arm.

4. The apparatus of claim 3 further comprising a slide-assist assembly including a frame member extending from said mounting frame and a slide mechanism operable to engage said frame member and manipulate said fixed anvil into contact with the first sheet material.

5. The apparatus of claim 4 wherein said slide-assist assembly comprises a slide rail, a guide mounted to said slide rail to capture said frame member, a cylinder operatively associated with a robot program and mounted to said slide rail to drive said mounting frame, and a cylinder brake mounted to said cylinder and operatively associated with said robot program.

6. The apparatus of claim 1 further comprising a vision system operably positioned for viewing the body-in-white to review the position of the first sheet material in a docked assembly-line position and coordinate positioning said cradle assembly to said final position by said second robotic arm.

7. The apparatus of claim 6 wherein said vision system is operable to send offset data to both said first and second robotic arms for manipulating a first reference frame of said first robotic arm and a second reference frame of said second robotic arm to align said roller head and said cradle assembly with the first sheet material.

8. The apparatus of claim 1 wherein said roller head comprises a pull-design that provides a roller to deliver said pressure at a plurality of pressure variances to hem the first sheet material.

9. An apparatus to cradle and hem panels at an assembly-line station with a docked body-in-white that has a first sheet material requiring a hemming operation, the apparatus comprising:

a roller head for hemming the first sheet material;

a first robotic arm operatively associated with said roller head;

a cradle assembly positionable from a pounce position to a final position, said cradle assembly having a fixed anvil that conforms to and rigidly supports the first sheet material;

a second robotic arm operatively associated with said cradle assembly for positioning said cradle assembly from said pounce position to said final position; and a central hub supported on said second robotic arm and accepting a plurality of autonomously shaped cradle assemblies, wherein said second robotic arm is operable to position each of said plurality of cradle assemblies from a non-use position to said pounce position.

10. A method to cradle and hem panels at an assembly-line station using a roller hemming device comprising:

determining a location of a first sheet material with a vision system and computing an offset of said location from a home position;

sending said offset to a first robot and a second robot to manipulate a first and second robot reference frame for aligning the roller hemming device with said first sheet material;

selecting a roller head with said first robot;

selecting a cradle assembly having a frame member and a cradle anvil with said second robot;

locating said cradle assembly from a pounce position and placing said frame member into a guide of a slide rail with said second robot;

moving said cradle assembly with said second robot into an approximate position relative to said first sheet material;

moving said side rail guide such that said cradle assembly is moved into a final position wherein said cradle anvil engages and supports said first sheet material;

fixing the location of said slide rail by applying a brake thereto;

manipulating said roller head with said first robot to form a hem on said first sheet material against an opposing pressure from said cradle anvil; and releasing said brake and manipulating said cradle assembly with said second robot to said pounce position.

* * * * *